US005979598A

United States Patent [19]

Wolf et al.

[11] Patent Number: 5,979,598

[45] Date of Patent: Nov. 9, 1999

[54] INTAKE SILENCER FOR MOTOR VEHICLE

[75] Inventors: Franz Josef Wolf, Bad Soden-Salmünster; Udo Gärtner, Steinau; Anton Wolf, Geinhausen; Nicole Schrieber, Steinau, all of Germany

[73] Assignee: Woco Franz-Josef Wolf & Co., Bad Soden-Salmünster, Germany

[21] Appl. No.: 08/983,024

[22] PCT Filed: Apr. 22, 1997

[86] PCT No.: PCT/EP97/02038

§ 371 Date: Mar. 26, 1998

§ 102(e) Date: Mar. 26, 1998

[87] PCT Pub. No.: WO97/40271

PCT Pub. Date: Oct. 30, 1997

[30] Foreign Application Priority Data

Apr. 22, 1996 [DE] Germany ..... 196 15 917

[51] Int. Cl.[6] ..... F01N 1/08

[52] U.S. Cl. ..... 181/272; 181/249

[58] Field of Search ..... 181/224, 229, 181/249, 255, 269, 272, 281, 282

[56] References Cited

U.S. PATENT DOCUMENTS

| | | | |
|---|---|---|---|
| 2,047,443 | 7/1936 | Starkweather et al. | 181/249 |
| 2,251,880 | 8/1941 | Cary et al. | 181/249 |
| 2,485,392 | 10/1949 | Leadbetter . | |
| 4,371,053 | 2/1983 | Jones | 181/249 |

FOREIGN PATENT DOCUMENTS

| | | |
|---|---|---|
| 48791 | 6/1938 | France . |
| 945632 | 5/1949 | France . |
| 580923 | 7/1933 | Germany . |
| 3531353 | 3/1987 | Germany . |

*Primary Examiner*—Khanh Dang
*Attorney, Agent, or Firm*—Lowe Hauptman Gopstein Gilman & Berner

[57] ABSTRACT

An intake silencer is designed as a broadband silencer for noises causes by intake of combustion air into internal combustion engines. To achieve the broadband effect, an axial sequence of resonator chambers with different volumes is formed by partitions which extend transversely to the intake pipe in a resonator that surrounds the intake pipe Each resonator chamber communicates through openings in the wall of the intake pipe with the air sucked through the intake pipe. By matching the open surface area of the openings, the thickness of the wall of the intake pipe in the area of the openings and the volume of the resonator chambers, a continuous broadband silencing may be set even over a wide frequency range, the range of practical interest in the present application extending combustion from to 1 to 10 kHz. In motor vehicles with an internal combustion engine, a supercharger and an air charge cooler, the intake silencer is advantageously arranged in the pressure pipe joint of the supercharger, directly behind it or integrated therein, but in any case at a certain distance upstream of the air charge cooler.

17 Claims, 2 Drawing Sheets

INTAKE SILENCER FOR MOTOR VEHICLE

TECHNICAL FIELD

The invention concerns a muffler for gas conduits and, more particularly, to an intake muffler for an internal-combustion engine.

BACKGROUND ART

An intake muffler of the above species is known from German patent document 743,418 A. FIG. 1 of this document shows, immediately after the intake-air filter, a muffler system wherein the intake pipe is fitted with wall apertures directly behind the dust-filter cartridge and is enclosed by an insulating material. After this segment, as seen in the direction of flow, the intake pipe comprises an axial sequence of apertures arrayed in an annular manner. Each aperture communicates with a chamber externally enclosing the intake pipe. The intake-air acoustic waves passing through any particular set of apertures are deflected by bell-shaped sleeves so that they move in counterflow to the intake-pipe airflow into the enclosing chamber and onto the radially directed chamber base. The chamber base acts as a reflector. As a result, the back-reflected acoustic waves moving towards the set of intake apertures effectively lower the acoustic admittance of the apertures in the intake pipe such that effectively coupled intake-muffling is achieved even at frequencies in the lower-frequency range.

Accordingly the state of the art disclosed in the '418 German reference discloses intake muffling by resonance-coupling of a reflection damper. Dampers of this construction are suitable only at low frequencies, for instance to dampen 2nd-order engine vibrations, since they comprise only a single resonance frequency per chamber. Moreover, they entail bulk due to the configuration of each reflecting chamber and the number of chambers required to achieve at least a moderately broad band in the intake muffler.

Another muffler for internal-combustion engines is known from German patent document 580,923 A in the form of an intake muffler or backfire damper. Boreholes determining resonance wavelengths in the exhaust pipe are enclosed by a sleeve because of the higher pressure in the exhaust pipe. This sleeve degrades the damping of the exhaust muffler.

Another intake muffler is known from U.S. Pat. 4,350,223. This intake muffler is inserted into a conduit consisting of a corrugated hose connecting an ambient-air suction aperture in the vehicle body to an inlet stub of the air filter. This intake muffler dampens air noise generated at the suction zone within a narrow frequency band straddling the resonance frequency of the resonator.

German offenlegungsschrift 32 34 634 A1 discloses a resonator of a similar construction which is integrated directly ahead of the filter inlet stub. Two rows of apertures connect the filter inlet stub acting as the intake pipe of the intake muffler to the inside of the enclosing resonator. Both rows of apertures are arrayed in such manner that they cause $\lambda/2$ and $\lambda/4$ damping relative to the natural frequency of the inlet stub. While muffler effectiveness is improved thereby, its bandwidth is not.

German patent document 35 31 353 C2 discloses an intake muffler "plugged" with damping material and integrated into the inlet stub of a booster-air cooling device to be used in an internal combustion engine fitted with a booster (supercharger).

The intake mufflers of the state of the art illustrated above effectively dampen only within a narrow frequency band.

Moreover, the muffler plugged with damping material are suitable only for systems having moderate superpressure. Mufflers damped with damping materials are unsuitable for a supercharger intake conduit.

It is known from International Patent Application WO 92/14922 A1 to construct a broadband intake muffler by connecting in parallel variously elongated side pipe resonators. Even though these resonators are made partly compact using labyrinths, this intake muffler is nevertheless still sufficiently bulky as to preclude practical use in automotive engineering.

It is already known, from European patent document EP 242 797 B1 as regards diffusers and from German offenlegungsschrift 41 34 408 A1 as regards a bypass resonator to construct intake mufflers with an effective broad bandwidth while averting bulk by using flaps and valves to produce matched damping systems which can be adjusted in relation to engine speed.

These systems incur the drawbacks of requiring a more or less complex regulating means, and additional installation space is required than for the initially described in-line resonators.

This state of the intake muffling art is faced with increasing ecological demands that motor vehicles shall reduce fuel consumption significantly. In particular, highly effective superchargers are inevitable to implement such goals.

The turbochargers presently used for such purposes operate at rotor speeds of nearly 200,000 rpm. Obviously turbochargers meeting such high requirements can practically remain economical only by trading off manufacturing tolerances. As a result, high acoustic radiation arises from such turbochargers, in particular the typical turbocharger "whistling" in the approximate frequency range of 2 to 4 kHz. In the process too, the boosting steps per se in the intake conduit also generate broadband radiated noise in the 4–6 kHz band, which is called "hissing".

Consequently, environmentally friendly motor vehicles shall require broadband absorbers of airborne noise in the foreseeable future in order to act as intake mufflers in motor vehicles using internal combustion engines charged by a supercharger and making it possible to effectively dampen the frequency band of 2 to 6 kHz.

Accordingly, it is an object of the invention to create a generally applicable broadband airborne-noise absorber which is also appropriate as an intake muffler for an internal combustion engine and which, while of minimal bulk that can be easily matched to specific requirements, allows effective damping of airborne noise uniformly over a broad frequency band. In particular, such an intake muffler shall be able to dampen noises acoustically generated and radiated by turbochargers in the approximate frequency band of 2 to 6 kHz to such an extent that for practical purposes they no longer can be heard either inside or outside the vehicle.

SUMMARY OF THE INVENTION

Accordingly, an intake muffler of the invention is such that the intake air flows through the muffler, within an intake pipe enclosed by a single though preferably two-pan resonator housing or two half-casings extending over the total length along which muffling occurs. Inside this resonator housing, the intake pipe is fitted with apertures in both sides of the intake pipe, connecting the inside of the intake pipe to the inside space of the resonator chambers formed in the resonator housing. Contrary to the state of the art, the intake pipe is not formed merely by comparatively thin steel sheet metal, but of such materials as aluminum, sintered metals, plastic or hard rubber, which permit manufacturing the intake pipe also with substantial wall thicknesses without making it unduly heavy. Preferably the wall thickness of the intake pipe runs in the range from 0.6 to 5 mm, especially between 1 and 3 mm inclusive. The wall thickness of the intake pipe, or the inside-wall height of the aperture in the intake pipe wall, depends on mutually matching the aperture cross-section, the volume of the connected resonator chamber and the width and frequency position of the resonator absorption band. Accordingly the apertures and the resonator chamber form a Helmholtz resonator tuned to the frequency band to be damped.

The width of the active resonance-absorption frequency band that can be adjusted in the above manner increases as the aperture cross-section decreases. However, because the coupling efficiency, that is the degree of possible damping, also simultaneously drops with a smaller aperture cross-section, this aperture cross-section must be optimized between these two boundary parameters.

The annular space formed by the resonator housing around the perforated intake pipe is sub-divided by partitions transverse to the axis of the intake pipe into a sequence of axial resonator chambers of different volumes. Appropriately, these partitions are integrated into the very resonator housing and enclose an inserted intake pipe. However, and alternatively, the intake pipe may very easily also be constructed to be solidly joined to the partitions enclosing it and may be inserted as such into the resonator housing. The critical feature merely is that the resonator chambers so formed be hermetically bounded relative to each other. In other words, "mutually hermetically bounded" means that the individual chambers are so bounded pneumatically and acoustically with respect to one another that the air volumes enclosed by them are easily coupled and, following the establishment of waves, can maintain stable resonance without interference, that is they have a fixed elastic constant.

It must be borne in mind that neither the intake pipe nor the resonator housing requires a linear longitudinal axis, or be coaxial or even have symmetry of rotation. The resonance behavior of each resonator chamber ultimately is only determined by the vibratory volume of air as regards its resonant frequency, not by all partitions being mutually parallel or that the intake pipe runs centrally inside the resonator housing or because the partitions are mutually parallel.

Another decisive feature is that the acoustic pressure arising in the intake airflow can act through the apertures and, by means of the mass of vibratory air in the volume of the aperture (and damped by wall friction), on each of the chambers formed in the resonator housing, namely separately on each of these chambers, without one of the chambers bridging, by one of the apertures in the intake pipe, over the chamber partitions into the neighboring chamber.

Because of these features the intake muffler of the invention can be matched practically to any installation space to achieve the highest compactness.

The primary resonance band associated with each resonator chamber can be determined by measuring the chamber volume and by means of the wall thickness of the intake pipe in the vicinity of the apertures associated to the particular chamber. The bandwidth adjusted for each particular chamber has the feature that the effective frequency band is inversely proportional to the aperture cross-section. As the aperture cross-section drops, however, damping will also drop, and a tradeoff is necessary between the required damping and the broadband damping possible for each chamber.

To construct a gapless broadband airborne noise absorber, the adjacent chamber is tuned such that the upper frequency of the absorption band of one chamber and the lower frequency of the absorption band of the neighboring chamber shall overlap sufficiently broadly. It is advantageous in this regard to construct the consecutive chambers so that their volumes shall constantly increase or decrease from one cell to the next. In other words, in a given direction, the volume of the resonator chamber shall steadily increase in the axial sequence of the consecutive chambers, namely from the first to the last chamber, and, in the opposite direction, shall steadily decrease correspondingly. The increase or decrease of chamber volumes from chamber to chamber in principle is independent of the direction taken by the intake air through the intake muffler. In both cases substantially identical good acoustic damping is achieved.

Illustratively, tuned intake mufflers may be constructed in this manner which, for a resonator housing length of less than 30 cm and for a sequence of 5 to 10 chambers, cover practically in gapless manner a damping frequency band of 1 to 10 kHz.

In principle the intake pipe and the intake muffler resonator of the invention may be manufactured using arbitrary materials. Contrary to the case of the known single-chamber, narrow-band intake muffler, the intake muffler of the invention allows the intake conduit and the resonator housing to be made of the same material because the resonator housing pan practically does not radiate. Moreover, additional damping materials are superfluous to suppress noise radiation from the resonator housing.

Preferably, the intake muffler of the invention is made of a heat-resistant, preferably fiber-reinforced plastic, or hard rubber, or also of porous sintered materials or porous materials, foremost of aluminum.

As discussed above, only the cross-section of the individual aperture, the number of apertures per chamber and the wall thickness of the intake pipe are determinative as regards coupling the available volume of air in each single resonator chamber to the acoustic pressure in the intake conduit to achieve both a natural damping frequency in the particular resonator chamber and the width of the natural frequency's frequency band. On the other hand, the geometry of the particular apertures does not have a significant effect on the characteristics of the intake muffler of the invention. For example, the apertures connecting the individual resonator chambers to the inside of the intake pipe may be round, cylindrical or oval, ovate, in the form of slots, or polygonal. Preferably, however, all the apertures of the intake pipe have a circular cross-section to facilitate its tuning.

The intake muffler of the invention operates practically free of flow losses and when used in motor vehicles equipped with superchargers is preferably mounted in the intake conduit between the supercharger and the supercharger-air cooling device. Furthermore, the intake muffler of the invention should be connected as tightly as possible to the pressure outlet side stub of the supercharger, e.g., it should be directly flanged onto the stub or connected to it through as short as possible an acoustically insulating connection, or else and preferably, it should be directly integrated into the pressure stub of the turbocharger, for instance in the manner known for the inlet stub of a supercharger-air cooling device disclosed in German patent document 35 31 353 C2.

DETAILED DESCRIPTION OF THE INVENTION

Figure 1:
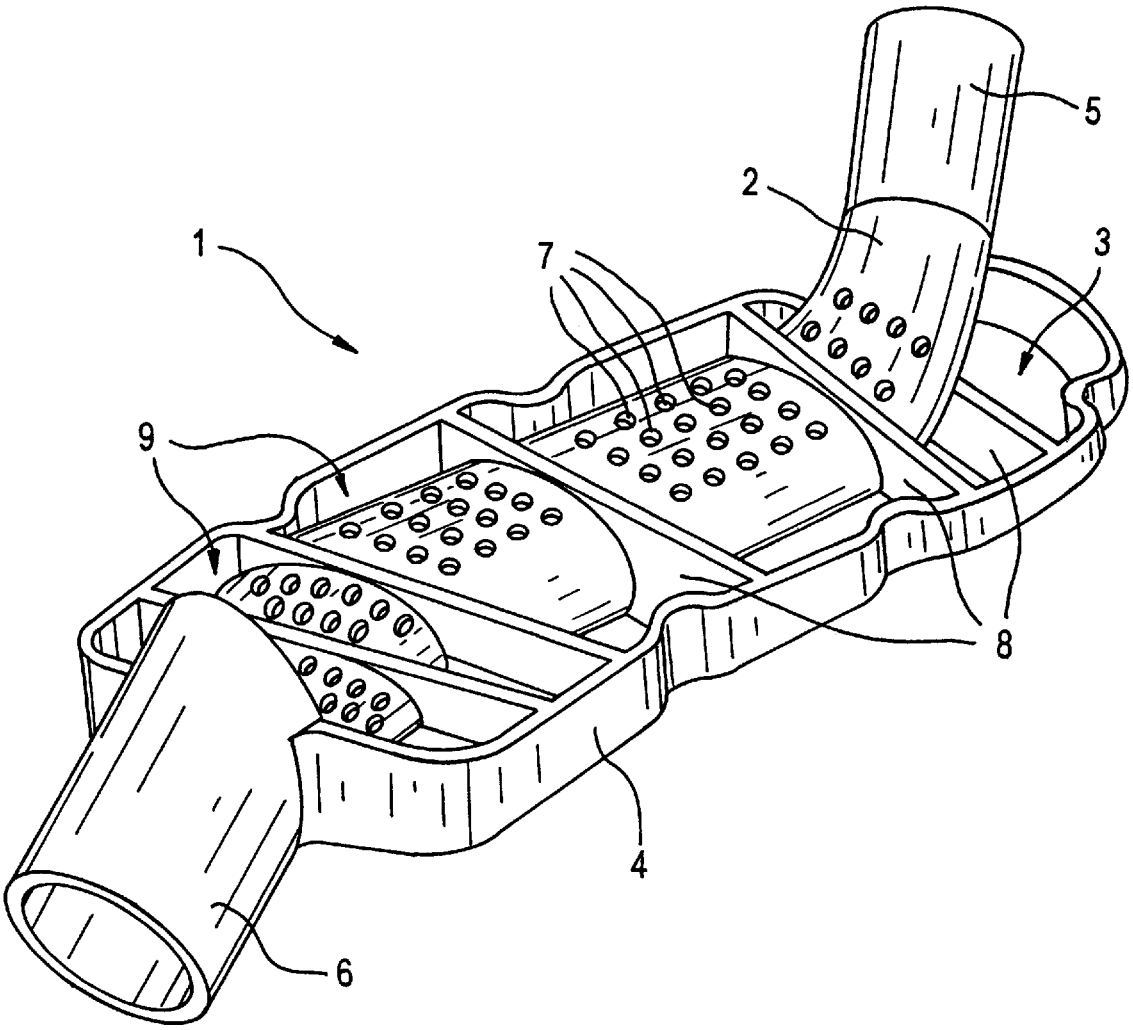
FIG. 1 is a perspective of an illustrative embodiment of the invention represented with the cover removed from the resonator housing.

The intake muffler shown in FIG. 1 to be used in an internal combustion engine has an in-line intake pipe 2 for intake air and a two-pan resonator housing 4 enclosing the pipe 2 to form a closed annular space 3, only one of the two housing pans otherwise assembled in a press-fit manner being shown for the sake of clarity. The intake muffler 1 is fitted with an inlet stub 5 and an outlet stub 6 for insertion into the intake conduit of the internal combustion engine. For the sake of clearer description of the invention, the inlet stub 5 is shown being integral with the intake pipe whereas the outlet stub 6 is shown integral with the shown resonator housing pan. In principle this configuration of the connection stubs is arbitrarily exchangeable. Preferably, however, both connection stubs, namely both the inlet stub and the outlet stub, shall be integral with the resonator housing such that one of the connection stubs is fitted into or otherwise integral with one of the two resonator housing pans, and the other stub similarly joins the other pan. As a result, for a construction of two pans of the intake pipe being inserted into the resonator housing, it is possible to apply a prestressing, closing pressure also serving to seal the resonator housing by welding, bolting or the like.

Apertures 7 are present in the wall of the intake pipe 2 to connect the inside of the intake pipe 2 to the annular space 3 of the resonator housing 4. Each aperture has a circular cross-section and its diameter is 3 mm when the wall thickness in the vicinity of the aperture of the intake pipe 2 is 2 mm.

Chamber walls, i.e. partitions 8, which are mutually complementing during closure of the housing cover, are formed in each of the half pans of the resonator housing 4 and run transversely to the longitudinal axis of the intake pipe 2. In the closed position, the chamber walls will sealingly enclose the outer surface of the intake pipe 2. Resonator chambers 9 are formed in this manner in axial sequence inside the resonator when the resonator housing is closed, each with a different volume. The individual chamber volumes are determined not only by the spacings of the partitions 8 but also by the specific configuration of the resonator housing 4 itself.

The apertures 7 are so arrayed in the intake pipe 2 that each resonator chamber 9 communicates with the inside of the intake pipe 2 while forming a small, vibratory mass of air in the aperture in such a way that no partitions shall be bridged, that is none of the neighboring chambers shall be affected.

As schematically shown in FIG. 1, all apertures 7 of the intake pipe 2 have the same geometric configuration and the same dimensions.

Ideally both the distribution and the number of the apertures 7 present in the intake pipe 2 shall be identical from one chamber 9 to the next chamber. Practically, however, the construction indicated schematically in FIG. 1 can rarely be achieved because spatial configurations and the bulk of the intake muffler must be taken into account.

In the construction shown in FIG. 1, the intake pipe inside the resonator housing 4 has an oval cross-section, a gutter-shaped zone of the intake pipe 2 running from the inlet stub 5 to the outlet stub 6 being free of apertures 7. This construction prevents condensed moisture entrained with the intake air, for instance atmospheric moisture or oil dust, condensing in the intake pipe 2, from passing through the apertures 7 into the resonator chambers 9, by allowing such moisture to exit through the outlet stub 6 of the intake muffler. It should be borne in mind that the mounted position of muffler 1 is obtained by rotating the intake muffler of FIG. 1 clockwise by 90° about the longitudinal axis of the intake pipe 2 such that the gutter-shaped zone 10 is faces vertically downward.

Figure 2:
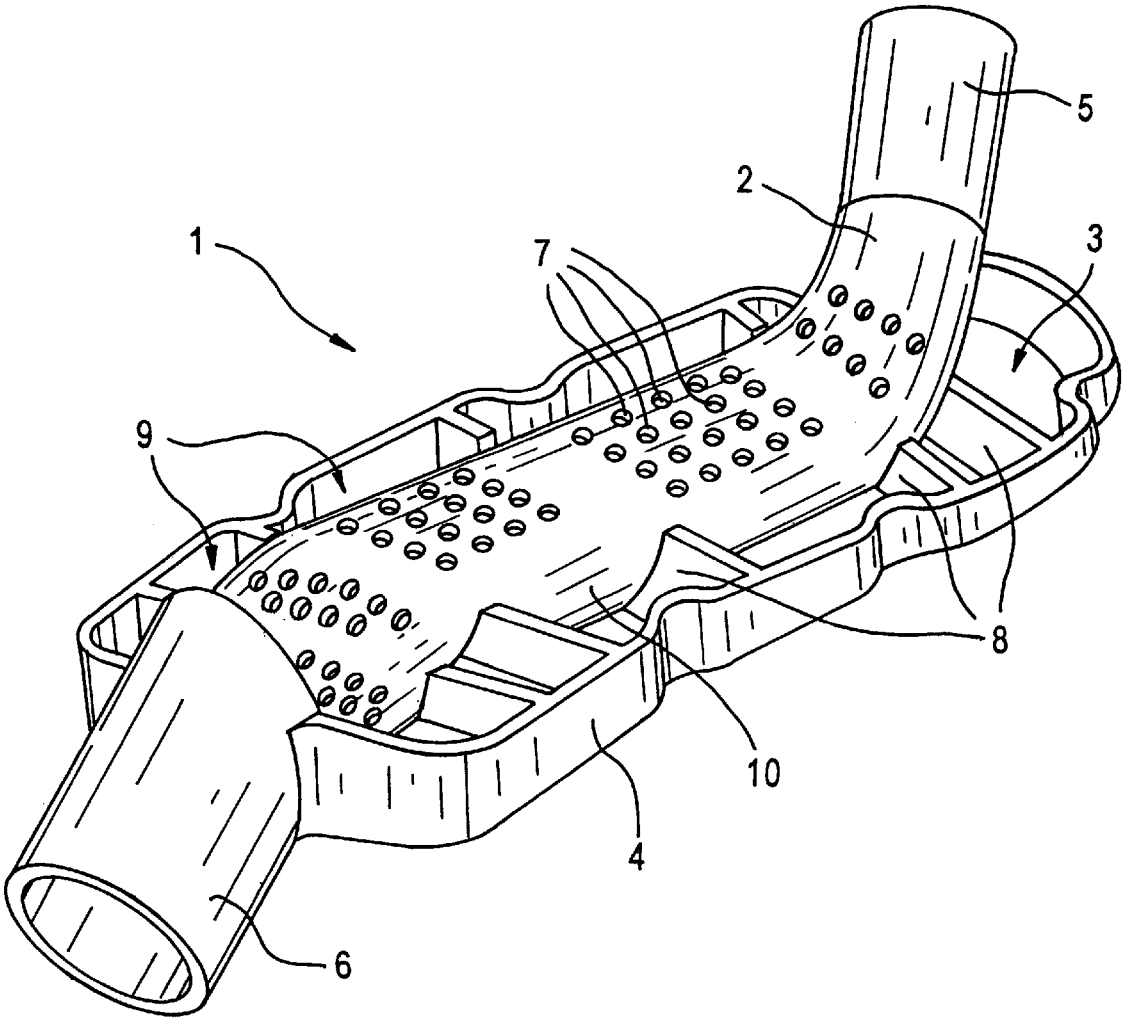
FIG. 2 is another perspective of an illustrative embodiment of the invention represented with the cover removed from the resonator housing

The half pan of the intake muffler depicted in FIG. 2 has chamber walls or partitions 18 that do not extend over the top of the intake pipe 2. The chamber walls of the half pan not depicted in FIG. 2 mutually complement the chamber walls 18 such that when in the closed position they sealingly enclose the outer surface of the intake pipe 2, thereby forming the resonator chambers 9. The gutter-shaped zone 10 of the intake pipe 2 is identical to that of the intake muffler depicted in FIG. 1.

We claim:

1. An internal-combustion-engine intake muffler, comprising an intake pipe for transmitting intake air and a resonator housing enclosing the intake pipe to form a closed annular space, said muffler being fitted with an inlet stub and an outlet stub, said intake pipe including apertures formed in a wall of the intake pipe which connect an inside space of the intake pipe to the closed annular space, further including a plurality of partitions separated from each other inside the resonator housing which extend transversely to a longitudinal axis of the intake pipe to form hermetically bounded resonator chambers of different volumes and, wherein the apertures are arrayed in the wall of the intake pipe such that each resonator chamber communicates with the inside of the intake pipe and not through the partitions, wherein resonator chamber volume, the cross-section of the apertures, the wall thickness of the intake pipe in the vicinity of the apertures for each resonator chamber are mutually sized to match the position and width of a construction-predetermined resonance frequency band for each said resonator chamber.

2. Intake muffler as claimed in claim 1, wherein the apertures in the wall of the intake pipe are circular.

3. Intake muffler as claimed in claim 1, wherein the apertures are arrayed in such manner in the wall of the intake pipe that each resonator chamber communicates through an equal number of apertures with the inside of the intake pipe.

4. Intake muffler as claimed in claim 1, wherein the intake pipe has an oval or a flattened oval cross-section.

5. Intake muffler as claimed in claim 1, wherein a wall segment in a base region of the intake pipe is formed without apertures continuously from the inlet stub to the outlet stub to the outlet stub, said wall segment being matched to the specified installed position of the intake pipe in a suction muffler and of the intake muffler at the internal combustion engine.

6. Intake muffler as claimed in claim 1, wherein the intake pipe is of a two-pan construction having an axial partition plane and the resonator housing has a two-pan construction having an axial partition plane.

7. Intake muffler as claimed in claim 1, wherein the intake pipe is an insertable component within the resonator housing.

8. Intake muffler as claimed in claim 1, wherein said inlet and outlet stubs are shaped into the resonator housing.

9. A motor vehicle comprising an internal combustion engine, a supercharger, a cooling device for the supercharger air and an intake muffler as claimed in claim 1, wherein said intake muffler being inserted between and connected to the supercharger and to the supercharger-air cooling device.

10. Vehicle as claimed in claim 9, wherein the intake muffler is connected directly after, or at, or integrated with, a pressure stub of the supercharger.

11. A muffler for a gas conduit, comprising an intake pipe for transmitting a gas within the conduit to an outlet, and a resonator housing enclosing the intake pipe to form a closed annular space, said muffler being fitted with an inlet stub and an outlet stub, said intake pipe including apertures formed in a wall of the intake pipe which connect an inside space of the intake pipe to the closed annular space, further including a plurality of partitions separated from each other inside the resonator housing which extend transversely to a longitudinal axis of the intake pipe to form hermetically bounded resonator chambers of different volumes and, wherein the apertures are arrayed in the wall of the intake pipe such that each resonator chamber communicates with the inside of the intake pipe and not through the partitions, wherein resonator chamber volume, the cross-section of the apertures, the wall thickness of the intake pipe in the vicinity of the apertures for each resonator chamber are mutually sized to match the position and width of a construction-predetermined resonance frequency band for each said resonator chamber.

12. Intake muffler as claimed in claim 11, wherein the apertures in the wall of the intake pipe are circular.

13. Intake muffler as claimed in claim 11, wherein the apertures are arrayed in such manner in the wall of the intake pipe that each resonator chamber communicates through an equal number of apertures with the inside of the intake pipe.

14. Intake muffler as claimed in claim 11, wherein the intake pipe has an oval or a flattened oval cross-section.

15. Intake muffler as claimed in claim 11, wherein the intake pipe is of a two-pan construction having an axial partition plane and the resonator housing has a two-pan construction having an axial partition plane.

16. Intake muffler as claimed in claim 11, wherein the intake pipe is an insertable component within the resonator housing.

17. Intake muffler as claimed in claim 11, wherein said inlet and outlet stubs are shaped into the resonator housing.

* * * * *